US005685710A

United States Patent [19]

Martinez Sagrera et al.

[11] Patent Number: 5,685,710

[45] Date of Patent: Nov. 11, 1997

[54] BARN AND PROCEDURE FOR VIRGINIA TYPE TOBACCO CURING

[76] Inventors: Jorge Martinez Sagrera; Michael Venturas; Michael Bernard, all of Eduardo Dato, 8—2o A, 14003 Cordoba, Spain

[21] Appl. No.: 553,598

[22] PCT Filed: May 11, 1995

[86] PCT No.: PCT/ES95/00054

§ 371 Date: Dec. 6, 1995

§ 102(e) Date: Dec. 6, 1995

[87] PCT Pub. No.: WO95/31117

PCT Pub. Date: Nov. 23, 1995

[30] Foreign Application Priority Data

May 12, 1994 [ES] Spain ..... 9401009

[51] Int. Cl.[6] ..... A24B 1/02

[52] U.S. Cl. ..... 432/500; 34/210; 34/212; 34/209; 34/215

[58] Field of Search ..... 34/210, 209, 212, 34/215; 432/500

[56] References Cited

U.S. PATENT DOCUMENTS

| | | | |
|---|---|---|---|
| 1,060,425 | 4/1913 | Buchrer | 34/210 |
| 1,605,634 | 11/1926 | Wright | 34/212 |
| 3,367,043 | 2/1968 | Torigian . | |
| 3,866,334 | 2/1975 | Huang . | |
| 3,932,946 | 1/1976 | Johnson . | |
| 3,935,648 | 2/1976 | Cox . | |
| 4,205,460 | 6/1980 | Taylor . | |
| 4,321,758 | 3/1982 | Fowler . | |
| 4,470,422 | 9/1984 | Joubert et al. | 432/500 |
| 4,499,911 | 2/1985 | Johnson . | |

FOREIGN PATENT DOCUMENTS

| | | |
|---|---|---|
| 8 406 174 | 1/1983 | Spain . |

*Primary Examiner*—Henry A. Bennett
*Assistant Examiner*—Jiping Lu
*Attorney, Agent, or Firm*—Fish & Richardson P.C.

[57] ABSTRACT

The objects of the present invention are a barn and a procedure for curing Virginia type tobacco. The barn consists of an air heating device with an impulsion fan (9) connected by means of an inlet duct (10) to several curing units (1–8) where the Virginia type tobacco leaves are contained said curing units (1–8) being mutually connected. The heated air introduced into the barn by the fan (9) flows continuously and sequentially through the curing units (1–8), said air thereby acquiring the adequate moisture and temperature for each step of the Virginia type tobacco curing process.

The barn and procedure of the invention provide improved fuel efficiency and ease of management.

14 Claims, 3 Drawing Sheets

| | | | |
|---|---|---|---|
| 4 | 3 | 2 | 1 |
| 5 | 6 | 7 | 8 |

BARN AND PROCEDURE FOR VIRGINIA TYPE TOBACCO CURING

OBJECT OF THE INVENTION

The barn of procedure for Virginia type tobacco curing which are the objects of the present invention provide improved fuel efficiency and ease of management. The proposed procedure may be applied to existing tobacco curing barns, conveniently adapted, or to new constructions; the method of construction is immaterial. The procedure can be applied to any method of handling the tobacco in the curing units, whether the leaves are tied by hand on strings, in metal clips, in racks as used in bulk barns, or in boxes or containers.

BACKGROUND ART

Curing of Virginia type tobacco is carried out by passing heated air through the ripe leaves (Spanish patent with publication No. 8406174). The air may be moved by fans or by convection, depending on the type of curing structure and the tobacco handling method. The process starts with a warm and humid atmosphere of about 35° C., and the temperature is increased gradually and the humidity decreased over a period of several days to a maximum of about 70° C. at the end of the cure. Suitable ventilation has to be provided to ensure that the moisture in the leaves is removed in a closely controlled manner. Conventional Virginia type tobacco curing barns have until now consisted of individual units in which the tobacco is processed independently, each curing unit providing its own separately regulated environment. The particular problems associated with the process are the following:

1. As the temperature increases and the humidity decreases, a significant amount of energy is wasted in the air exhausted from the unit, even in the final step with 70° C. heated air, thus limiting the thermal efficiency which can be attained.
2. Constant control of the condition of the air is needed, because the wrong combination of temperature and humidity may affect the tobacco adversely, thus requiring close attention to the degree of ventilation in relation to the temperature, humidity and state of the tobacco.
3. When the cure is complete, the tobacco is dry and brittle, and requires the addition of sufficient moisture to soften it enough to allow it to be handled for removal from the barn. It is important that this step should be achieved rapidly to allow re-use of the barn, and is usually done by injecting water sprays or steam into the barn, both of which require additional mechanisms and control.

Some of these problems have been tried to be solved, for example, by providing the barn with a heat exchanger, so that the hot and humid air which leaves the curing unit warms the cold and dry air which enters the unit from outside (Spanish Utility Model with application No. U9103183). Thereby, the thermal efficiency of the process is improved but the other mentioned problems associated with the conventional barns for tobacco curing still remain unsolved.

BRIEF DESCRIPTION OF THE INVENTION

The barn for tobacco curing which is the object of the present invention, solves the problems already mentioned by connecting the curing units in such manner that the same air is passed sequentially through each unit in turn, creating a continous air flow. The air is heated to the required temperature before being introduced into the barn, and as it passes through the tobacco picks up moisture, which causes a decrease in temperature and increase in humidity. This creates temperature and humidity gradients within the curing units which correspond exactly with the requirements of the curing process. Each unit is, therefore, an integrated part of the whole barn. The means of heating the air is not relevant to the curing and may any suitable method provided the air remains clean and uncontaminated, for example gas burners.

The advantages of the Virginia type tobacco curing barn and procedure of the present invention are the relevant energy saving (25–50%) and the better control of the curing procedure. These advantages derive from the fact that the air flows through all the units integrated in the barn instead of being wasted as in the conventional barns, thus implying a significant energy saving. Similarly, because the temperature and humidity gradients affect all of the units simultaneously and are relatively stable because they are determined by the curing process itself, the difficulty of maintaining the correct temperature/humidity relationship during the cure is obviated and control greatly eased.

DETAILED DESCRIPTION OF THE INVENTION

Figure 1:
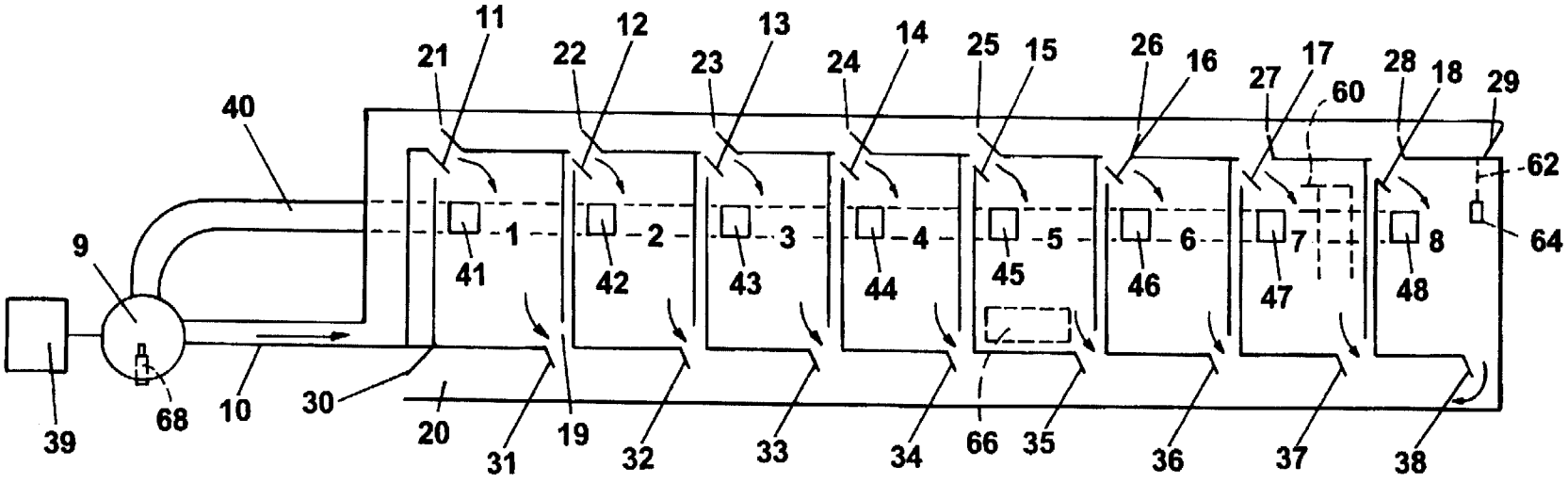
FIG. 1: Diagram of the Virginia type tobacco curing barn according to the present invention.

FIG. 1 displays a diagram of the Virginia type tobacco curing barn of the present invention. After passing through a heating device e.g. propane burners (68) and an impulsion fan (9), the air enters an inlet duct (10) connected to all the curing units (1–8) integrated in the barn. These units can be built of wood, metalwork or other manufacturing. The air may be introduced into any of said curing units by means of a series of valves (21–28). The duct (10) is provided in the opposite extreme to the inlet with another valve (29) leading to the exterior. Under normal operation, just one of these valves (21–28) is opened, thereby allowing airflow into one of the curing units.

Initially, after passing through valves (21) and (11), the air enters the curing unit (1), where, after contacting the tobacco leaves placed in said unit (1) (in bulk e.g., in boxes or containers (66), racks (60) or hanging from bars on strings (62) fastened with clips (64)) the air enters a transfer duct (19) which leads to the next curing units (2) and similarly through each unit in turn (3–8) until it passes through all of them integrated in the system. Valves (11–18) installed in each curing unit (1–8) prevent the air from flowing the wrong way in the system when it is introduced into the first unit (1). These valves (11–18) are similar to valves 21–28 and, as another alternative, each two-valve set (11 and 21, 12 and 22 etc.) can be replaced by a unique valve with double effect.

Figure 2:
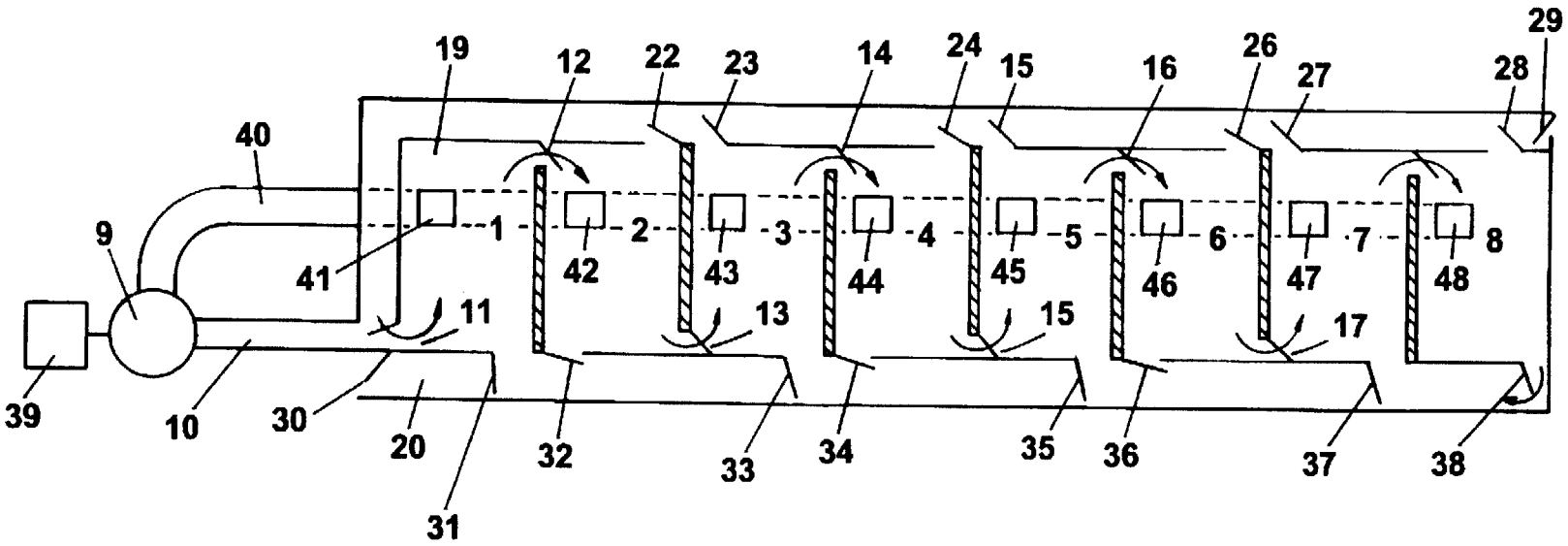
FIG. 2: Diagram of an alternative Virginia type tobacco curing barn according to the present invention.

The transfer duct (19) connecting the curing units (1–8) of the barn may introduce the air into the top of each unit, as shown in FIG. 1, the bottom of each unit, or the top and bottom of alternate units (FIG. 2). The air may be introduced into and depart from the front, rear or the sides of the curing units as convenient in each particular case; the direction of movement and point of entry or exit of the air is not relevant for the procedure of Virginia type tobacco curing by means of the barn which is the object of the present invention.

According to this sequential connection, the air passes from the last curing unit (8) through a connecting duct (20) back to the first unit (1), said transfer duct (20) being provided with valves (31–38), each conducting to a curing unit (1–8). In normal operation the air is first introduced into the next curing unit (1–8) in the series on a daily basis, so that in terms of the airflow any of the curing units (1–8) may be the first in the sequence. After the air has passed through the last unit required, either curing or conditioning, it is exhausted to atmosphere either through an open loading door or through specific valves (41–48) which allow the extraction of the air out of the curing units (1–8) to a duct (40). This air, as another option, can be passed through a heat exchanger (39) to be conditioned so that part of it can be reused and fed back to the inlet air current. The rest of the air can be used for the conditioning of a tobacco storage chamber. The transfer duct (20) is also provided with a valve (30) that allows the air to be exhausted without passing through any other unit.

In operation, when a unit completes the curing process, the input air is switched into the next unit in the series, which then becomes the first in the sequence of air flow. The completed unit is allowed to cool to room temperature and is then connected to the end of the system (last curing unit in the sequence of air flow) to receive the moist air leaving said last curing unit in the sequence of air flow, where the ripe tobacco leaves have been placed in the last charge of the barn. In this way, the final tobacco humidifying process (conditioning) to avoid the tobacco getting dry and brittle is achieved without the need for sprays or other mechanisms. When the conditioning is completed, the unit is emptied and refilled with ripe tobacco leaves to become in its turn the last curing unit in the sequence of air flow (first unit of the tobacco curing process). In this manner a unit is emptied and refilled every day and the process in effect cycles around all the curing units in the barn.

FIG. 2 displays, as already mentioned, an alternative barn system, in which the air inlet in the curing units (1–8) is done sequentially through the top and bottom of each unit. In this case, the double effect valve (11) allows the introduction of air proceeding from the impulsion fan (9) through the transfer duct (10) into the first curing unit (1), or through the following valves (22–28) to the consecutive units (2–8).

Figures 3, 4:
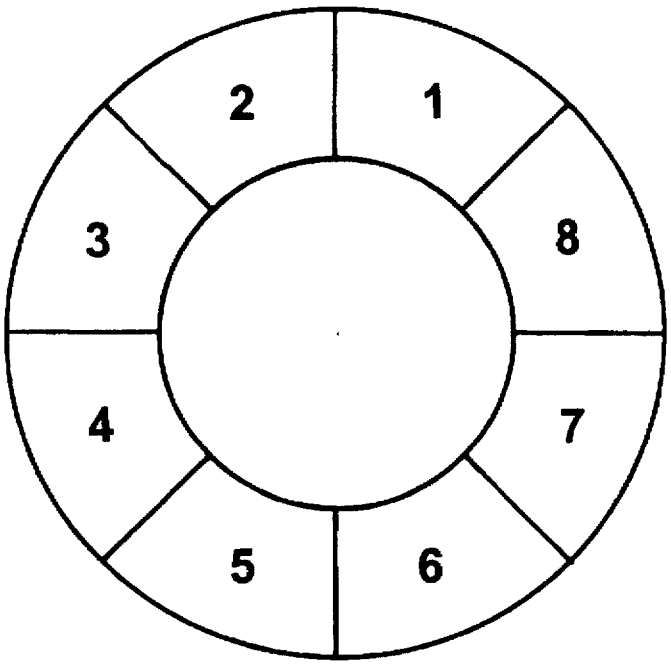
FIG. 3: Diagram of curing units arranged in two opposite rows formed by the same number of curing units.
FIG. 4: Diagram of curing units arranged in a circle.

FIGS. 1 and 2 display the barns to the present invention with the curing units arranged in a row. Alternatively, the curing units integrating the barn can be arranged in a circle (FIG. 4), in two opposite rows formed by the same number of curing units etc. In each case, the connecting ducts can be arranged in the most convenient way, without the novelty and inventiveness of the invention being affected thereby, which consists in the continous and sequential circulation of air through the curing units, said air thereby acquiring the adequate moisture and temperature for each step of the Virginia type tobacco curing process.

PREFERRED EMBODIMENT OF THE INVENTION

A barn for curing Virginia type tobacco formed by 8 curing units built of ironwork and with 15 $m^3$ volume each unit, is filled with 1000 Kg of Virginia tobacco per unit which makes a total of 8000 Kg of tobacco.

By means of gas burners and an impulsion fan, the air circulates at 5500 $m^3$/hour through the barn. The air heated to 70° C. and at room humidity (approx. 45%) is introduced through the top of the unit which contains the tobacco leaves in racks and which in the sequence is in the last step of the curing process. The air contacts the tobacco at each temperature of the curing process for 24 hours. When passing to the next curing unit, the air temperature drops to 66° C. Sequentially, the air is forced to pass through all the other units forming the barn, entering each one in an alternant way through the top and the bottom. The air temperatures in each curing unit are indicated in the following table:

TABLE 1

Air temperatures in each curing unit

| Curing unit | Temperature (°C.) |
|---|---|
| 1 | 70° |
| 2 | 66° |
| 3 | 62° |
| 4 | 57° |
| 5 | 52° |
| 6 | 45° |
| 7 | 38° |
| 8 | 35° |
| Air exhaust | 30° |

The air humidity at the exit of the last unit in the sequence of air flow, where the ripe tobacco leaves have been recently introduced for their first curing step, is of 90%.

The tobacco which is in the last curing step of the process (first unit in the air flow sequence at 70° C.), once is finished is left for cooling to room temperature. Afterwards, it is put into contact during 6 hours with humid air (90% moisture and 30° C. temperature) proceeding from the unit which in the moment is the last one in the air flow sequence, so that it is conditioned in terms of humidity to ease its handling.

The energy saving achieved in this eight-units barn compared with a conventional barn of similar capacity has been of 40%.

We claim:

1. Barn for curing Virginia type tobacco, said barn comprising:

a plurality of curing units (1–8) arranged in series, each curing unit of said plurality of curing units defining a volume for receiving and containing tobacco during a curing process;

an inlet duct (10) in communication with each said curing unit in said plurality of curing units;

a connecting duct (20) in communication with each said curing unit in said plurality of curing units;

an air heating device with an impulsion fan (9) in communication with said inlet duct; and an exhaust duct (40) in communication with each said curing unit in said plurality of curing units;

each said curing unit of said plurality of curing units comprising:

inlet valve means (21–28) disposed between said inlet duct (20) and said curing unit (1–8) for movement between a first position to allow flow of air between said inlet duct and said curing unit and a second position for restricting flow of air between said inlet duct and said curing unit;

connecting valve means (31–38) disposed between said connecting duct (20) and said curing unit (1–8) for movement between a first position to allow flow of air between said curing unit and said connecting duct and a second position for restricting flow of air between said curing unit and said connecting duct;

a transfer duct (19) connecting said curing unit to an adjacent curing unit; and transfer valve means (11–18) disposed between said transfer duct (19) and said curing unit (1–8) for movement between a first position to allow flow of air between said transfer duct and said curing unit and a second position for restricting flow of air between said transfer duct and said curing unit;

whereby, by predetermined arrangement of said valve means, air can be caused to flow through said curing units in a predetermined, variable sequence.

2. Barn for curing Virginia type tobacco according to claim 1, wherein tobacco leaves are disposed on racks (60) in said sequential curing units.

3. Barn for curing Virginia type tobacco according to claim 1, wherein tobacco leaves are disposed on strings (62) hung by metal clips (64) in said sequential curing units.

4. Barn for curing Virginia type tobacco according to claim 1, wherein tobacco leaves are disposed in containers (66) in said sequential curing units.

5. Barn for curing Virginia type tobacco according to claim 1, wherein said air heating device comprises propane burners (68).

6. Barn for curing Virginia type tobacco according to claim 1, wherein said sequential curing units are arranged along a row.

7. Barn for curing Virginia type tobacco according to claim 1, wherein said sequential curing units are arranged in two opposite rows formed by a same number of curing units.

8. Barn for curing Virginia type tobacco according to claim 1, wherein said sequential curing units are arranged in a circle.

9. Barn for curing Virginia type tobacco according to claim 1, wherein said barn further comprises a heat exchanger for conditioning inlet air by exchange with air leaving said barn.

10. The barn for curing Virginia type tobacco of claim 1 wherein each said curing unit of said plurality of curing units further comprises exhaust valve means (41–39) disposed between said exhaust duct (40) and said curing unit (1–8) for movement between a first position to allow flow of air between said curing unit and said exhaust duct and a second position for restricting flow of air between said curing unit and said exhaust duct.

11. The barn for curing Virginia type tobacco of claim 1 further comprising a heat exchanger in communication between said exhaust duct and said inlet duct.

12. Procedure for curing Virginia type tobacco in a barn in manner to achieve required humidity and temperature in each step of a curing process, said procedure being characterized by the steps of:

a. providing a barn for curing Virginia type tobacco, said barn comprising: a plurality of curing units (1–8) arranged in series, each curing unit of said plurality of curing units defining a volume for receiving and containing tobacco during a curing process; an inlet duct (10) in communication with each said curing unit in said plurality of curing units; a connecting duct (20) in communication with each said curing unit in said plurality of curing units; an air heating device with an impulsion fan (9) in communication with said inlet duct; and an exhaust duct (40) in communication with each said curing unit in said plurality of curing units; each said curing unit of said plurality of curing units comprising: inlet valve means (21–28) disposed between said inlet duct (20) and said curing unit (1–8) for movement between a first position to allow flow of air between said inlet duct and said curing unit and a second position for restricting flow of air between said inlet duct and said curing unit; connecting valve means (31–38) disposed between said connecting duct (20) and said curing unit (1–8) for movement between a first position to allow flow of air between said curing unit and said connecting duct and a second position for restricting flow of air between said curing unit and said connecting duct; a transfer duct (19) connecting said curing unit to an adjacent curing unit; and transfer valve means (11–18) disposed between said transfer duct (19) and said curing unit (1–8) for movement between a first position to allow flow of air between said transfer duct and said curing unit and a second position for restricting flow of air between said transfer duct and said curing unit;

b. arranging the valve means to cause air to flow sequential through said curing units in a predetermined, variable sequence corresponding to stages of curing of Virginia type tobacco leaves in said curing units;

c. placing a set of Virginia type tobacco leaves to be cured in the volume of a first curing unit, with Virginia type tobacco leaves at other stages of curing in other curing units of said plurality of curing units;

d. introducing air at room humidity and heated to 70° C. by a heating device through an inlet duct into the first curing unit;

e. causing air to flow from the first curing unit through a transfer duct into an adjacent curing unit, and sequentially through said plurality of curing units;

f. maintaining a temperature drop between adjacent curing units of said plurality of curing units in a range of 3°–7° C.;

g. during a complete curing cycle, causing the air to increase in humidity up to 90% and to decrease in temperature to 30° C.;

h. after a predetermined period of contact of the Virginia type tobacco leaves contained in the first curing unit with the air, rearranging the valve means to cause a different curing unit to be the first curing unit, with the former first curing unit becoming a second curing unit; and i. repeating steps c–h, to advance the set of Virginia type tobacco leaves through a cycle of the plurality of curing units, thereby to cure the set of Virginia-type tobacco leaves.

13. The procedure for curing Virginia type tobacco in a barn of claim 12, wherein said predetermined period of contact is about 24 hours.

14. The procedure for curing Virginia type tobacco in a barn of claim 12 comprising the further steps of:

providing a heat exchanger;

delivering air from a last sequential curing unit of the plurality of curing units to the heat exchanger; and passing air to the impulsion fan through said heat exchanger for recovery of heat energy.

* * * * *